US005951844A

United States Patent [19]

Jansen et al.

[11] Patent Number: 5,951,844

[45] Date of Patent: Sep. 14, 1999

[54] PROCESS AND APPARATUS FOR DESILVERING A SILVER-CONTAINING SOLUTION

[75] Inventors: Benedictus Jansen, Geel; Werner Van de Wynckel, Mortsel; Frank Michiels, Arendonk, all of Belgium

[73] Assignee: Agfa Gevaert, Mortsel, Belgium

[21] Appl. No.: 08/827,639

[22] Filed: Apr. 10, 1997

Related U.S. Application Data

[60] Provisional application No. 60/019,509, Jun. 4, 1996.

[30] Foreign Application Priority Data

Apr. 23, 1996 [EP] European Pat. Off. ..... 96201084

[51] Int. Cl.[6] ..... C25C 1/20; C25C 7/06

[52] U.S. Cl. ..... 205/571; 205/702; 205/771; 204/228.1; 204/230.2; 204/271; 204/229.9

[58] Field of Search ..... 205/571, 702, 205/771; 204/228, 231, 275, 228.1, 229.9, 230.2

[56] References Cited

U.S. PATENT DOCUMENTS 5,454,924 10/1995 Jansen et al. ..... 204/231
5,770,034 6/1998 Janset et al. ..... 204/231

*Primary Examiner*—Arun S. Phasge
*Attorney, Agent, or Firm*—Baker & Botts, L.L.P.

[57] ABSTRACT

An apparatus for de-silvering silver-containing solutions comprises an electrolytic cell (10) having an anode (20), a cathode (30) and a reference electrode (45) positioned adjacent the cathode (30), and electrical power supply control means (41) for controlling the supply of electrical power to the anode (20) and the cathode (30). Operation of the cell (10) is controlled potentiostatically while the current exceeds a certain threshold value and the current is controlled galvanostatically at that threshold (minimum) value in circumstances in which the potentiostatic control would result in a current below the threshold value. To this end, the power supply control means (41) includes means (60) for adjusting the cathode potential and control means (70) linked to said adjustment means (60) for controlling operation of the cell potentiostatically at a selected cathode potential, means for monitoring the current drawn through the cell during such potentiostatic control and for comparing such current with a threshold current, and means for controlling the cell galvanostatically at such threshold current value, means for switching from potentiostatic to galvanostatic control in response to cell current dropping below said threshold value, means for periodically re-establishing said selected cathode potential, and means for reverting from galvanostatic to said potentiostatic control in response to a cell current above said threshold value when said selected cathode potential is re-established.

15 Claims, 4 Drawing Sheets

PROCESS AND APPARATUS FOR DESILVERING A SILVER-CONTAINING SOLUTION

This application claims the benefit of U.S. provisional application No. 60/019,509 filed Jun. 4, 1996.

FIELD OF THE INVENTION

The present invention relates to a process and apparatus for the electrolytic recovery of silver from solutions containing silver, in particular used photographic solutions such as fixing solutions.

BACKGROUND OF THE INVENTION

Electrolytic silver recovery from used photographic solutions is a common way of extending the life of such solutions. An apparatus for the electrolytic recovery of silver from solutions containing silver is known from European patent application EPA 93200427.8 (Agfa-Gevaert NV) filed Feb. 16, 1993. The apparatus comprises an electrolytic cell having an anode and a cathode, and electrical power supply control means for controlling the supply of electrical power to the anode and the cathode. The control of the electrochemical process taking place at the anode and the cathode is important in the silver recovery process. If too high a potential difference is applied, side-reactions can occur, depending upon the nature of the silver-containing solution, leading to unwanted by-products, and adhesion of the silver to the cathode may be poor. If too low a potential difference is applied, de-silvering takes place only slowly. The de-silvering process proceeds by depositing silver upon the cathode. If the silver does not adhere strongly to the cathode, there is a risk that it will become detached therefrom, especially as the weight of silver deposited increases and especially in continuously operated cells which have a constant flow of electrolyte solution passing over the cathode. The detached silver may fall to the bottom of the cell where it eventually builds up to a level which may cause a short circuit between the anode and the cathode. Some detached silver may be flushed out of the cell with the electrolyte liquid. In either case the de-silvering of the solution is not optimally achieved.

The theoretical conditions required for optimum de-silvering depend upon a number of factors including the cathode potential, the concentration of silver in the silver-containing solution, the pH of the silver-containing solution (usually within the range of from 3.5 to 6.0), the composition of the seasoned fixer and the condition of the cathode. For a given fixer composition, de-silvering apparatus, pH and cathode condition, there is an ideal cathode potential, or narrow range of cathode potentials, which provides fast deposition, good adherence of the silver to the cathode and a low level of side-reactions. Outside these optimum conditions, these objectives may not reliably be met. As the de-silvering process continues, the concentration of silver in the silver-containing solution changes as silver is deposited and fresh solution is added, the pH of the solution is unknown or varies in an unpredictable manner and the condition of the cathode may change. It has not therefore been possible to set the electrolytic cell to the optimum de-silvering conditions and to maintain optimum conditions as the de-silvering continues.

There is a number of known methods of controlling the de-silvering process, referred to herein as (i) galvanostatic, (ii) constant potential difference, (iii) quasi-galvanostatic, (iv) quasi-potentiostatic and (v) potentiostatic control.

i) Galvanostatic Control

In galvanostatic control, a constant current flows through the cell while it is in operation. As the de-silvering progresses, the level of silver in the solution falls and the ohmic resistance between the anode and the cathode increases. It is therefore necessary to increase this potential difference in order to maintain a constant current. While the instrumentation required for this control is very simple, the method suffers from the fact that at high silver concentrations the potential difference is small and therefore de-silvering takes place only slowly, while at low silver concentrations the potential difference may be sufficiently high that undesirable side-reactions are liable to occur, adhesion of the silver to the cathode is bad and sulphidation of the cathode occurs.

ii) Constant potential Difference Control

In a constant potential difference control method, the potential difference between the anode and the cathode is kept constant as the de-silvering progresses. The disadvantage of this method is that the potential difference between the cathode and the solution is not controlled. The electrochemical reactions taking place at the cathode are therefore also uncontrolled, depending on a large number of factors such as the size of the anode, agitation in the neighbourhood of the anode, the presence or absence of components in the solution which can be oxidised and the ease with which they can be oxidised (e.g. $SO_3^{--}$ and $S_2O_3^{--}$), the ohmic potential drop in the cell and therefore also the cell geometry and current density, and the current through the cell.

iii) Quasi-Galvanostatic Control

In a quasi-galvanostatic control mode, the current through the electrolytic cell is kept at a constant target value, but this target value is itself adjusted from time to time, according to specific operational parameters of the de-silvering. One example of quasi-galvanostatic control is as follows: During operation of the cell, the silver content is determined by (external) analysis. The target current value is then adjusted to a specified value, depending on the silver content measured (high current for high silver contents, low current for lower silver content in the fixer), After some time, the analysis is repeated and the target current value is set according to the new silver content measured. The time interval between two successive silver analyses is determined by the speed of de-silvering. When de-silvering is very fast, e.g. 50% decrease of silver content in 60 min. the analysis may be necessary every 15 minutes. When de-silvering is very slow, e.g. 50% decrease of silver every 600 minutes, a new analysis of silver content is only required every 200 minutes. (The same may hold, of course, for very fast or slow addition of silver to the fixer to be de-silvered.) Generally speaking, in quasi-galvanostatic control, the frequency of updating of the target current value is determined by the time during which the operational parameters of the cell remain substantially constant. These operational parameters may be of electrochemical/chemical or mechanical nature.

The operational parameters include:

silver content in the fixer to be de-silvered, pH of the solution to be de-silvered, presence or absence of toxifying substances in the fixer, fixer flow rate through the electrolysis unit, conductivity of the electrolyte. An exhaustive list of possible operational parameters would include all factors which are important in the de-silvering process. In general, however, only a limited number of them are significantly variable in any given de-silvering situation. In many cases, only one factor is monitored (e.g. silver content). Other examples of quasi-galvanostatic control are:

Estimation of the silver content in the fixer to be de-silvered by measurement of the rest potential of the electrolytic cell (rest potential of cathode versus anode) and adjustment of the cell current target value according to some predetermined relation between the measured rest potential and the current target value. The rest potential of the cell could be measured between the cathode and the anode, or between the cathode and some other electrode. That other electrode could for example be a reference electrode, for example a Ag/AgCl electrode. Alternatively, such a reference electrode could be a pH sensitive electrode.

Estimation of the electrolyte flow rate through the electrolysis unit and adjustment of the target current value according to the flow rate.

Estimation of the silver content of the solution to be de-silvered by analysing the response of the current to changes in the applied potentials (cathode/anode potential versus cathode/ anode/third electrode).

Estimation of the silver content or detoxification potential by analysing the response of the current versus cathode potential (or any other potential difference between cathode/anode/third electrode) and adjustment of the current.

iv) Quasi-Potentiostatic Control

In quasi-galvanostatic control, it is the target current which is adjusted as a function of one or more operational parameters of the de-silvering. In quasi-potentiostatic de-silvering, a target potential difference is adjusted as a function of one or more operational parameters of the de-silvering. This target potential difference may be any accessible potential difference in the electrolysis cell (potential differences between cathode, anode, reference electrodes, pH sensitive electrodes, other electrodes). An important example of quasi-potentiostatic control is a control algorithm according to which the anode-cathode potential difference is kept constant at a value which is determined by the current flowing through the cell.

v) Potentiostatic Control

In potentiostatic control, a reference electrode is included in the electrolytic cell and the potential difference between the cathode and the reference electrode is kept constant. This allows complete control over the cathode potential. This method of operation is therefore widely preferred, since it is the cathode potential which determines electrochemical reactions which take place in a fixer of a certain composition. By using a reference electrode, the influence of the anode potential (and largely also the ohmic potential contributions) are excluded. This enables the initial cathode potential to be set at a level where bad silver adhesion, side-reactions and sulphidation of the cathode can be avoided, independently of the anode potential. The use of a reference electrode makes the equipment more reliable, since factors such as the current density at the anode, the surface state of the anode, over-potential at the anode (caused by changes in solution composition), and ohmic potential drops no longer influence the cathode potential. As the de-silvering process continues and silver is removed from the solution, the current through the cell falls while the potential difference between the cathode and the reference electrode is maintained at a fixed level. When fresh solution with a higher silver content is subsequently added, the current through the cell will normally increase and silver continues to be deposited on the cathode.

These five basic de-silvering control methods referred to above form the basic principles underlying a number of possible actual control mechanisms which are used in commercial equipment. In commercial equipment, the control method may be a hybrid of a number of the control methods referred to. For example, many commercial applications use the combination of constant anode-cathode potential difference and quasi-potentiostatic control, as the applied cathode-anode potential is kept constant to a predetermined level which is set according to the current measured through the cell. The advantage of potentiostatic control has long been recognised (see for example French patent FR 1357177 (Bayer) and it is also used in commercial equipment (e.g. ECOSYS F08, and ECOMIX from Agfa-Gevaert NV).

Another interesting patent U.S. Pat. No. 5,310,466 (granted to John La Riviere et al.) describes a quasi-potentiostatic control mechanism. More in particular, it describes a specific case of a quasi-potentiostatic control mechanism according to which the anode-cathode potential difference is kept constant at a value which is determined by the current flowing through the cell.

In practice, it is sometimes observed that, although the silver content of the bath to be de-silvered is high (for example Ag>3 g/L) and the de-silvering apparatus as such is in good working order, no silver becomes deposited on the cathode. This effect is attributed to "cathode poisoning". Poisoning occurs when components present in the solution block the cathode reduction process. Not all cases of cathode poisoning are understood, but certain components which are present in the developer or which are flushed out of the film may be the cause. A number of photographic stabilisers exhibit this effect, such as phenyl mercapto tetrazol. In European Patent Application No. 95.201.954.5 (Agfa-Gevaert NV), we have proposed a process for de-silvering a silver-containing solution in which, whereas the potential difference between the cathode and a reference electrode normally lies within a de-silvering range to cause silver to be deposited on said cathode, the cathode potential is at least periodically reduced (i.e. made more negative) as the de-silvering process continues.

In such a periodic control method, the cell is firstly operated under potentiostatic conditions. After a given period of time, the cathode potential is decreased to a predetermined level. Thus, when the solution is placed in the cell, and the apparatus is switched on, the cell current is rather high and the cathode potential is set at a first level. As the de-silvering process continues and the level of silver in the solution falls, the cell current falls. During this time the cathode potential is maintained at its first level. After a given period of time however, the cathode potential is adjusted to a lower (i.e. more negative) level. The cathode potential is held at this lower level for a given period of time, referred to as a detoxification period, after which it is returned to the first level. Such process may include a plurality of de-silvering steps interposed by relatively brief detoxifying steps. In another control method which may be operated continuously, it was proposed that the cathode potential be reduced according to a predetermined relationship between the cathode potential and the current flowing through the cell as the de-silvering process takes place, independently of any changes in the anode potential. The predetermined relationship between the cathode potential and the cell current is of a form whereby the cathode potential is lower (i.e. more negative) as the cell current falls. In simplified form this relationship may be expressed as:

$$U=U_O+k(I-I_{max})$$

where U is the cathode potential when the cell current is I, $U_O$ is the cathode potential when the cell current is at its maximum $I_{max}$, and k is a positive non-zero coefficient, which in the simplest case is a constant. Note that if k were zero, this relationship would reduce to $U=U_O$, i.e. the potentiostatic control method.

In such a relationship, k is so chosen that the minimum cathode potential (which occurs when I=0) i.e. $U_O-k.I_{max}$, is not so low that undesirable side-reactions occur to a significant extent. In the case of cathode poisoning, it may be advisable to chose larger values for k. This k is also chosen so as not to fully compensate for the fall in current, i.e. the cell current will continue to fall as the de-silvering continues. If k were so chosen as to fully compensate for the fall in cell current, the cell current I would remain constant, corresponding to the galvanostatic control method.

This control method may be carried out so that the cathode potential is continuously adjusted to a level determined by the cell current, in accordance with the predetermined relationship. Thus for example, when the solution is placed in the cell, the cell current is high and the cathode potential is at a first level. As the de-silvering process continues and the level of silver in the solution falls, the cathode potential is adjusted to lower (i.e. more negative) levels determined by the cell current, in accordance with the predetermined relationship. When, for example, the silver levels rise, the cell current rises and the cathode potential is adjusted to higher (i.e. less negative) levels determined by the cell current, in accordance with the predetermined relationship and the control sequence is repeated.

That proposal was based upon the discovery that the effects of poor silver adhesion and cathode poisoning during the de-silvering step could be substantially overcome by applying a lower cathode potential during part of the de-silvering process, so that in the next de-silvering step the efficiency of the process substantially returned and was maintained for a number of further de-silvering steps.

While it is known that the application of a lower cathode potential may lead to side-reactions and the generation of unwanted by-products, it was thought that by limiting the cathode potential to a level determined by the cell current, or by limiting the total charge which is passed through the electrolysis cell, the effect of such side-reactions, such as for example the reduction of sulphite at the cathode surface, over the whole de-silvering process would be minimised.

An even better way to circumvent silver adhesion problems and cathode poisoning problems is the use of a galvano-dynamic control algorithm, as described in European Patent Application No 95.201.953.7 (Agfa-Gevaert NV). In this mode of operation, the diffusion limitation current is estimated by applying a more negative potential to the cathode. Afterwards, the current is galvanostatically controlled to a value which is a certain fraction of this estimated limitation current density. By doing this, one avoids depositing substantial amounts of silver while current limitation conditions subsist, thus avoiding bad silver adhesion.

Moreover, by the use of a galvanostatic control routine, cathode poisoning is largely circumvented, since the cathode potential will automatically be made negative enough to avoid cathode poisoning. In comparison with the automatic decrease of cathode potential as the current drops, as described in European Patent Application No 95.201.954.5, the advantage of the galvano-dynamic control algorithm is that it works better when de-silvering conditions, such as the pH of the solution, vary.

The galvano-dynamic current control algorithm performs well when the cathode detoxification potential (the cathode potential at which the poisoning is overcome by the more negative cathode potential) is not less negative than the potential used to estimate the diffusion limitation current density (e.g. −530 mV versus a glass electrode). If the detoxification potential is more negative (e.g. −590 mV versus a glass electrode), no detoxification will take place during the measurement of the limitation current density, and the resulting currents will be very low, resulting in a very slow de-silvering.

Reduction of the cathode potential to more negative values (e.g. −600 mV versus glass electrode) for determination of the limitation current may not be advisable, since in this case, side reactions such as sulphite reduction and eventually also sulphidation of the cathode may occur. This would result in, among other unwanted effects, an over-estimation of the silver limitation current, and consequently bad silver adhesion.

Thus, the galvano-dynamic control algorithm is not ideally suited for de-silvering fixers of low pH, where onset of sulphite reduction occurs very rapidly because the cathode potential at which sulphite reduction starts to occur is pH dependent. It is also less suited in situations where very severe cathode poisoning occurs. It was discovered that e.g. in the field of X-ray processing, in order to draw current through the cell and deposit silver on the cathode, it may be necessary to increase the potential difference between the cathode and the electrolyte to such an extent that in the absence of any poisoning, the majority of the current drawn would be due to sulphidation rather than silver reduction. Thus the potential required to be applied to the cathode to overcome the poisoning may be so great that in the absence of any such poisoning, it would engender significant side-reactions, and in the result it would be impossible to tell how much of the current flowing was due to desirable deposition of silver and how much to such undesirable side-reactions.

In difference to e.g. U.S. Pat. No. 5,310,466, the present patent application comprises a control mechanism wherein a truely potentiostatic control (keeping the potential of the cathode constant with respect to a reference electrode) is combined with a type of galvanostatic control. By doing so, we get a system which has both the advantages of a galvanostatic control and the advantages of a potentiostatic control. Thereabove, the present invention does not have the disadvantages of a quasi-potentiostatic control device such as the one described in U.S. Pat. No. 5,310,466, and is less susceptible to cathode poisoning.

SUMMARY OF THE INVENTION

It is an object of the present invention to provide a process for the de-silvering of silver-containing solutions in which account may be taken of any poisoning of the cathode and which enables such de-silvering to be performed rapidly and efficiently.

It is a further object of this invention to combine a potentiostatic control mechanism with a specific quasi galvanostatic control mechanism to counteract specific de-silvering problems which may be encountered when de-silvering fixer solutions where the cathode detoxification potential is more negative than the potential of onset of side reactions (i.e. reactions other than silver reduction reactions) on the cathode surface.

According to the invention there is provided a process for de-silvering a silver-containing solution by use of an electrolytic cell having an anode, a cathode and a reference electrode, the process comprising:

(i) supplying silver-containing solution to the electrolytic cell to immerse the anode, cathode and reference electrode therein; and (ii) applying electrical power to the anode and the cathode such that the cathode potential relative to the reference electrode, lies within a de-silvering range to cause silver to be deposited on said cathode;

characterised in that operation of the cell is controlled potentiostatically while the current exceeds a certain threshold value and in that the current is controlled galvanostatically at that threshold (minimum) value in circumstances in which the potentiostatic control would result in a current below the threshold value.

The invention extends to apparatus suitable for performing the process and accordingly provides apparatus for de-silvering a silver-containing solution including an electrolytic cell having an anode, a cathode and a reference electrode positioned adjacent said cathode, and electrical power supply control means for controlling the supply of electrical power to said anode and said cathode, said potential relative to said anode and said reference electrode, and control means linked to said adjustment means, characterised in that said control means includes means for controlling operation of the cell potentiostatically at a selected cathode potential, means for monitoring the current drawn through the cell during such potentiostatic control and for comparing such current with a threshold current, and means for controlling the cell galvanostatically at such threshold current value, means for switching from potentiostatic to galvanostatic control in response to cell current dropping below said threshold value, means for periodically re-establishing said selected cathode potential, and means for reverting from galvanostatic to said potentiostatic control in response to a cell current above said threshold value when said selected cathode potential is re-established.

It has not previously been proposed to associate with a single cell a control system which is capable of being switched between potentiostatic and galvanostatic control modes respectively based on a selected cathode potential and a selected minimum threshold current. The advantage of doing so is particularly apparent when operating with electrolyte solutions which are especially apt to poison the cathode, and also when operating with solutions which have a rather low pH, for example a pH below about 5, and particularly a pH within the range 4.2 to 4.8 as may commonly be encountered in the field of photographic processing solutions used in X-ray film processing.

In preferred embodiments of the invention, the magnitude of said threshold value of current passing through the cell is determined from an estimation of the silver content of the solution to be de-silvered. This estimation may be performed in any way, but in a preferred embodiment, it is done by measuring the rest potential of the cell, preferably the rest potential of the cathode versus a reference electrode or a pH sensitive electrode. By using a reference electrode with known potential, it is easy to estimate the silver content by measuring the rest potential of the cathode versus the reference electrode. If of a pH sensitive electrode is used, the pH of the fixing solution has to be approximately known, since uncertainties in the pH will result in uncertainties of the estimated silver content.

In normal operation, the cell is preferably controlled potentiostatically at a cathode potential which is suitably selected with regard to rest potential of the cell, which gives an indication of the silver content of the solution. It is especially suitable that such potentiostatic control is performed to control the magnitude of the potential between the cathode and the reference electrode at a value between −20 mV and −300 mV, preferably between −40 mV and −150 mV, with respect to the cathode rest potential.

The quality of the silver deposition depends not only on the silver content, but also on other factors which are not necessarily all known at all times in every de-silvering situation. Therefore the minimum threshold current which is used in the control algorithm is preferably chosen conservatively, this means a not too high value for the estimated silver content. This avoids undesirable effects such as side reactions or bad silver adhesion.

In normal operation, the cell will be controlled potentiostatically at a cathode potential which is suitably selected so as substantially to avoid any undesirable side-reactions within the electrolyte. In the recovery of silver from photographic fixing solutions, perhaps the most important of these side-reactions is the reduction of sulphite. The potential at which the reduction of sulphite starts to take place is largely dependent on the pH of the fixing solution. Therefore, it is preferred that the magnitude of said selected cathode potential is determined at least in part in dependence upon the pH of the electrolyte. In order to promote rapid de-silvering, it is desirable that the selected cathode potential should be as low (that is as strongly negative) as is possible while substantially avoiding undesired sulphite reduction reactions. In many instances we have found that it is most beneficial to work at cathode potentials between −500 and −590 mV, and preferably between −530 and −560 mV versus a glass electrode. In cases where the pH of the silver-containing solution can vary widely, e.g. over more than unity, it is preferable to use a true reference electrode as a third electrode to estimate the silver content more accurately.

In the case where the variation of the pH of the fixer is limited, it may be preferable to use a glass electrode as reference electrode, since it allows a better de-silvering in potentiostatic control, as has been disclosed in European patent specification EP 598144 (Agfa-Gevaert NV).

In order to take account of any such limited variation in the pH of the electrolyte as de-silvering proceeds, it is most preferable, since it allows a better de-silvering in potentiostatic control, for the cathode potential to be measured with reference to a reference electrode which is itself pH-sensitive, such as a glass electrode, a hydrogen electrode, a quinhydrone electrode and an antimony electrode, most especially a glass electrode which is relatively maintenance free and which is moreover insensitive to hydrostatic pressure variations. The use of a suitable glass electrode has been disclosed in European patent specification EP 598144 (Agfa-Gevaert NV). The potentials mentioned herein referring to glass electrodes refer to such an electrode having a potential of +208 mV versus NHE at a pH of 7.

Uncertainties in the pH must then be considered in the conservative estimation of the threshold current for any silver concentration. The positioning of the reference electrode is important to the de-silvering process. While in principle the electrode would be best placed between the cathode and the anode, as close as possible to the cathode, this may cause troubles as more and more silver is deposited on the cathode, which is thus growing thicker. When the reference electrode is placed further from the cathode, say 20 mm therefrom, ohmic potential drops will cause the potentiostatic de-silvering not to be truly potentiostatic. It has therefore been proposed to place the reference electrode on the far side of the cathode from the anode, but close to the cathode. We prefer to place the reference electrode at a distance of 5 mm from the cathode, and the potential difference values quoted herein are based on such a distance. If the reference electrode is placed nearer to or further from the cathode, an appropriate correction needs to be applied. In any event, the reference electrode should preferably be positioned at a location, such as from 1 mm and 50 mm from the cathode, where the potential measured while the cell is in operation, corresponds within 100 mV, preferably within 30 mV, to the potential that would be measured with the reference electrode in front of the cathode.

In one embodiment of the electrolytic cell, the cathode includes an opening extending from the outer face to the inner face, the opening being located in the neighbourhood of the reference electrode to ensure that the reference electrode is located within the electrical field of the cell. The reference electrode may conveniently be positioned adjacent an outlet port of the cell.

In preferred embodiments of the invention, the magnitude of said threshold value of current passing through the cell is determined at least in part in dependence upon the rest potential of the cell. The rest potential of the cell gives an indication (if the pH of the electrolyte is known) of the silver concentration in the electrolyte, and it is of course the silver concentration within the electrolyte which determines the magnitude of the current which can be drawn through the cell in order to deposit silver at the cathode. In fact the pH of the electrolyte will generally be predictable with a range of usually about 1 or less, depending on the particular species of solution which is to be de-silvered. For example in the photographic processing art, fixing solutions used in medical X-ray processing tend to have a pH within the range 4.2 to 4.8, whereas people working in the graphic arts field are accustomed to working with fixing solutions having a pH within the range 4.4 to 5.6.

Given the rest potential of the cell, i.e. the natural potential of the cell at which no current is drawn, a range of silver concentrations corresponding to the possible range of pH of the electrolyte can be predicted. Taking a conservative estimate, for example the minimum theoretical silver concentration, there can be calculated a current which will be sustainable without any substantial ill effects in all reasonably foreseeable practical situations. This current may be taken as the threshold value of current magnitude.

A current of that magnitude will thus be sustainable by the deposition of silver without any adverse side-reactions, no matter what potential has to be applied in order to draw that current through the cell. It will be appreciated that while the cathode remains poisoned, it may be necessary to operate the cell at very low (strongly negative) cathode potentials.

It is for this reason that in accordance with the invention, the cell is controlled galvanostatically during this phase of operation. A constant current is thus drawn through the cell. As cathode detoxification proceeds, the potential difference required to draw this current will decrease and the cathode potential may be increased. Thus even in cases where severe cathode poisoning is intermittently present, de-silvering can take place without a high proportion of current flow due to unwanted side-reactions.

During the course of operation, and depending on the processing conditions, the degree of cathode poisoning will fluctuate, and the cathode will become detoxified to a lesser or greater extent. Periodic monitoring of the current which actually flows through the cell at the (potentiostatically maintained) normal operating cathode potential and comparison of that current with the galvanostatically maintained current allows switching back to potentiostatic control when sufficient detoxification has taken place to allow silver deposition at that potential and thus permits more rapid de-silvering than maintaining the (rather conservatively selected) threshold current.

The silver-containing solution may be selected from photographic fixing and bleach-fixing solutions. The silver concentration in the silver-containing solution is typically from 0.1 g/L to 5 g/L. Where the silver-containing solution is a fixing solution, the process of the invention is particularly effective if the fixing solution has a volume of less than 100 mL/g, most preferably less than 40 mL/g of silver to be fixed thereby, because at low replenishment rates, the importance of unwanted side-reactions becomes greater, and the likelihood of cathode poisoning increases.

Preferably, the magnitude of said threshold value of current passing through the cell is determined at least in part in dependence upon analysis of response of the current to changes in the applied potentials (cathode/anode potential against cathode/anode/third electrode).

The silver-containing solutions which can be de-silvered using the present invention include any solution containing silver compelling agents, e.g. thiosulphate or thiocyanate, sulphite ions and free and complexed silver as a result of the fixing process. The apparatus can also be used with rinsing water or concentrated or diluted used fixing solutions, possibly contaminated with carried-over developer. Apart from the essential ingredients, such solutions will often also contain wetting agents, buffering agents, sequestering agents and pH adjusting agents. The silver-containing solution may comprise compounds preventing the formation of fog or stabilising the photographic characteristics during the production or storage of photographic elements or during the photographic treatment thereof. Many known compounds can be added as fog-inhibiting agent or stabiliser to the silver halide emulsion. Suitable examples are inter alia the heterocyclic nitrogen-containing compounds such as benzothiazolium salts, nitroimidazoles, nitrobenzimidazoles, chlorobenzimidazoles, bromo-benzimid-azoles, mercaptothiazoles, mercaptobenzothiazoles, mercaptobenzimidazoles, mercaptothia-diazoles, aminotriazoles, benzo-triazoles (preferably 5-methyl-benzotriazole), nitrobenzo-triazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolo-pyrimidines such as those described in British patent Nos. GB 1203757, GB 1209146 and GB 1500278 and Japanese patent application No. 75-39537, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as, for example, mercury or cadmium salts and the compounds described in Research Disclosure No. 17643 (1978), Chapter VI.

The process is particularly applicable in cases of low replenishment rates, because components carried over from the developer for example, and components which are flushed out of the film (such as stabilisers, surfactants and sensitisers), are more concentrated. In particular, surfactants may aggravate the poisoning effects of stabilisers such as phenyl mercapto tetrazol. The de-silvering process can be carried out batch-wise or continuously, the apparatus being connected to the fixing solution forming part of a continuous processing sequence.

The apparatus according to the invention may be designed to be operated manually, automatically or automatically with manual over-ride.

The material used for the anode is not especially critical, although platinised titanium is usually used. Platinum, graphite and noble metals are alternatives. The anode may be in the form of a rod, located at the axis of the electrolytic cell, where this is in cylindrical form.

The cathode may be formed from a generally flat sheet of flexible material, an electrically conductive surface being provided on one major face thereof, securing means being provided to enable the sheet to be folded into and secured in an open circular cross-sectional configuration. The cathode preferably ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver containing materials cause fewer starting-up problems.

In a preferred embodiment of the invention, the electrolytic cell comprises a housing, an anode, a removable cathode and a reference electrode all positioned within the housing. The cathode has an inner face directed towards the anode and an outer face directed towards the reference electrode. In use, silver from the silver containing solution is deposited on the face of the cathode which is directed towards the anode. In a suitable embodiment of the invention, the electrolytic cell housing is formed of electrically non-conductive material and may be generally cylindrical, although other shapes are possible. A cylindrical shape to the cell enables the cathode to be positioned near to the wall of the housing. The anode has a generally linear configuration axially located within the housing. The cathode has an open circular cross-sectional configuration surrounding the anode. The reference electrode is located in a side arm of the housing. Preferably, the housing further comprises a liquid inlet and a liquid outlet for the electrolyte liquid, predetermining a liquid level within the cell. In an embodiment of the cell, the housing is provided with an electrically conductive contact surface above the liquid level and clamping means serve to clamp a contact portion of the cathode against the contact surface of the housing to complete an electrical connection to the cathode. The contact portion of the cathode should have an electrically conductive surface. The provision of the contact surface in an upper part of the electrolytic cell housing, in particular an annular contact surface, enables this surface to be above the level of the electrolyte in the cell in use, thus reducing the risk of leakage and corrosion.

Where the electrolytic cell includes a liquid inlet and a liquid outlet, the process according to the invention may include the step of continuously supplying silver-containing solution to the cell through the inlet and continuously removing de-silvered solution from the outlet. The silver-containing solution may be supplied to the electrolytic cell at rate of from 5 to 25 L/minute.

PREFERRED EMBODIMENTS OF THE INVENTION

The invention will now be further described, purely by way of example, by reference to the accompanying drawings in which.

Figure 1:
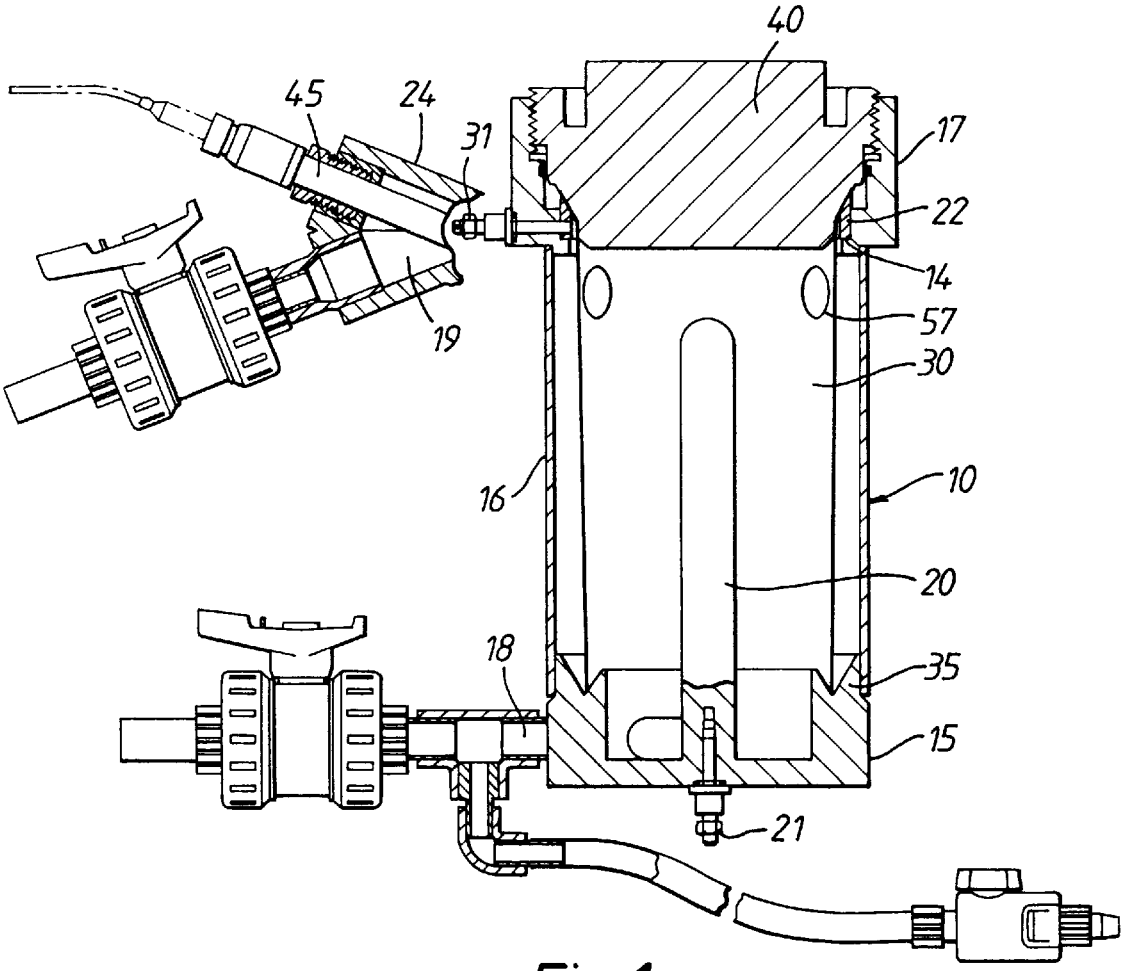
FIG. 1 shows, partly in cross-section, an electrolytic cell for use in accordance with the invention.

As shown in FIG. 1, the apparatus comprises an electrolytic cell 10, formed of electrically non-conductive material such as PVC, and comprising a base 15, sides 16 and an upper portion 17. An electrolyte inlet port 18 is provided towards the bottom of the cell and an electrolyte outlet port 19 is provided towards the top of the cell.

An anode 20, in the form of a platinised titanium rod, is secured to the base of the cell by means of a bolt 21 which acts as an electrical connector for the anode. The anode 20 lies along the axis of the cell 10. A reference electrode 45 is positioned in a side arm 24 of the cell 10 and protrudes into the outlet port 19 of the cell. A suitable reference electrode is a pH sensitive glass electrode such as a YOKOGAWA SM21/AG2 glass electrode which is an electrode having a potential of +208 mV versus NHE at a pH of 7. The upper part 17 of the cell is in the form of a neck portion having an opening defined by a stainless steel ring 22. The contact surface of the ring 22 is frusto-conically shaped, having its narrower radius downwards. The stainless steel ring 22 is permanently fixed to one end of a bolt 31 which extends through the wall of the cell and provides a connector for the cathode 30. Positioned in the neck of the cell, above the level of the annular ring 22, is a sealing ring 14.

The apparatus further comprises a lid 40 so shaped as to fit into the neck portion of the cell. The lid 40 is formed of electrically non-conductive material such as PVC. The lower portion of the lid 40 is shaped to correspond to the shape of the ring 22. The cathode 30, formed for example of a flat stainless steel sheet 50 having a thickness of 100 mm, is wrapped around into a frusto-conical configuration, where the upper radius is marginally larger than the lower radius by a factor of 1.05. The cathode 30 has a deformable upper edge portion. The sheet material of which the cathode is formed is sufficiently resilient to allow upper edge portion to bend outwardly in response to outwardly directed force. The deformable upper edge portion of the cathode lies adjacent the stainless steel ring 22. Tightening of the lid causes the upper edge portion of the cathode 30 to be clamped firmly by the lid against the ring 22, thereby establishing good electrical contact there-between.

The cathode is provided with a number of openings 57 which extend therethrough. The cathode 30 is located in the cell 10 with its bottom edge supported by a cathode support ledge 35 in the cell. One of the openings 57 is located in the neighbourhood of the reference electrode 45.

Figure 2:
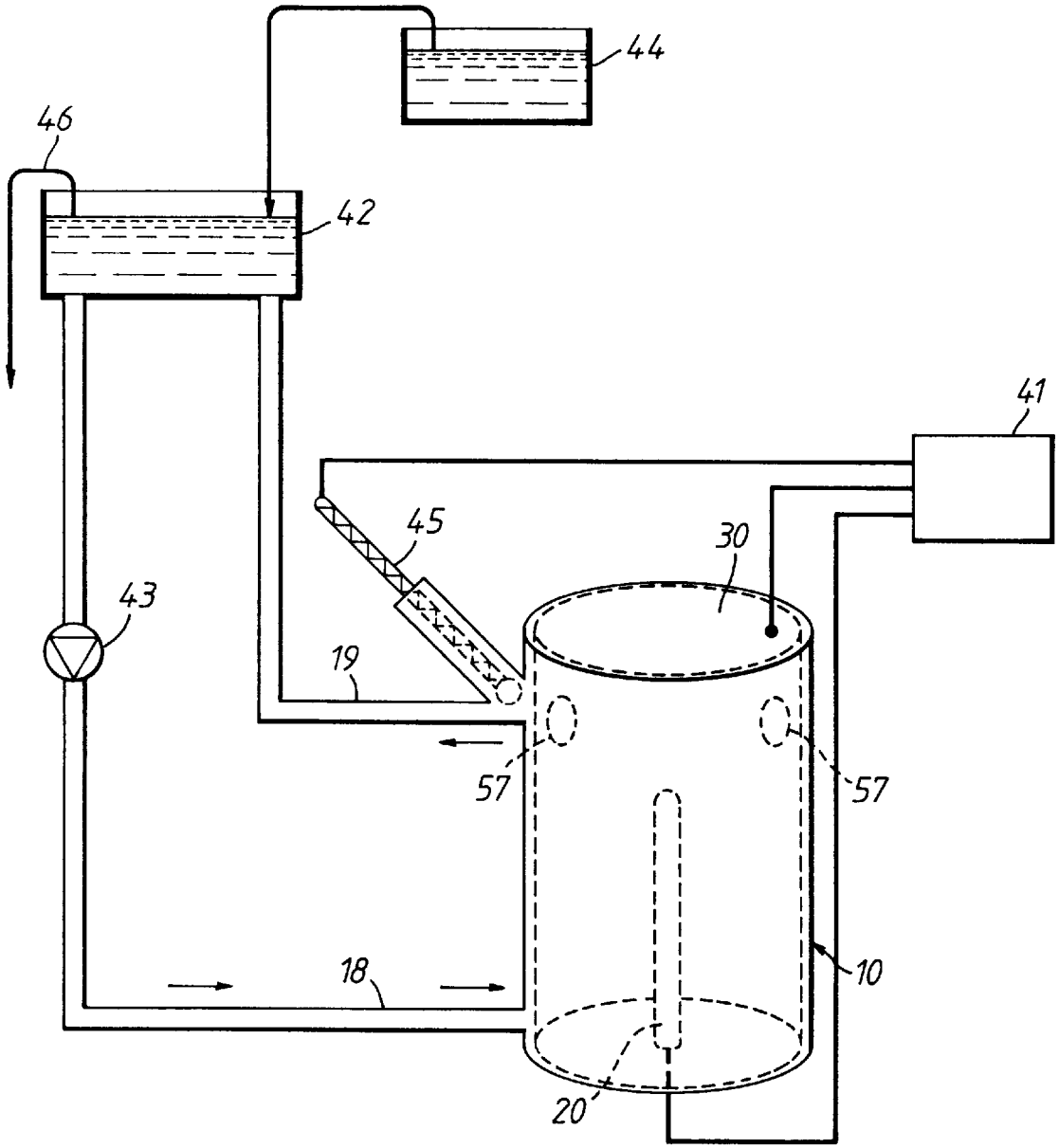
FIG. 2 is a schematic representation of the use of an apparatus according to the present invention.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. The effect of the sealing ring 14 is to prevent the electrolyte level rising above the level of the outlet port 19, so maintaining an air space above the liquid and preventing contact between the liquid and the surface of the ring 22. The risk of corrosion of the latter is thereby reduced and the opening of the cell is made easier because the air space fulfils a compression-decompression function. Referring to FIG. 2 it will be seen that the anode 20, the cathode 30 and the reference electrode 45 of the electrolytic cell 10 are connected to a potential control device 41 which controls the application of electrical power to the anode and the cathode. The cell 10 is fed with contaminated fixer from a first fixer container 42 via a pump 43 which is provided with a filter (not shown). The contaminated fixing solution is topped up from time to time with fresh fixing solution from a second fixer container 44, while the total liquid volume is maintained at a constant level by means of an overflow 46.

Figure 3:
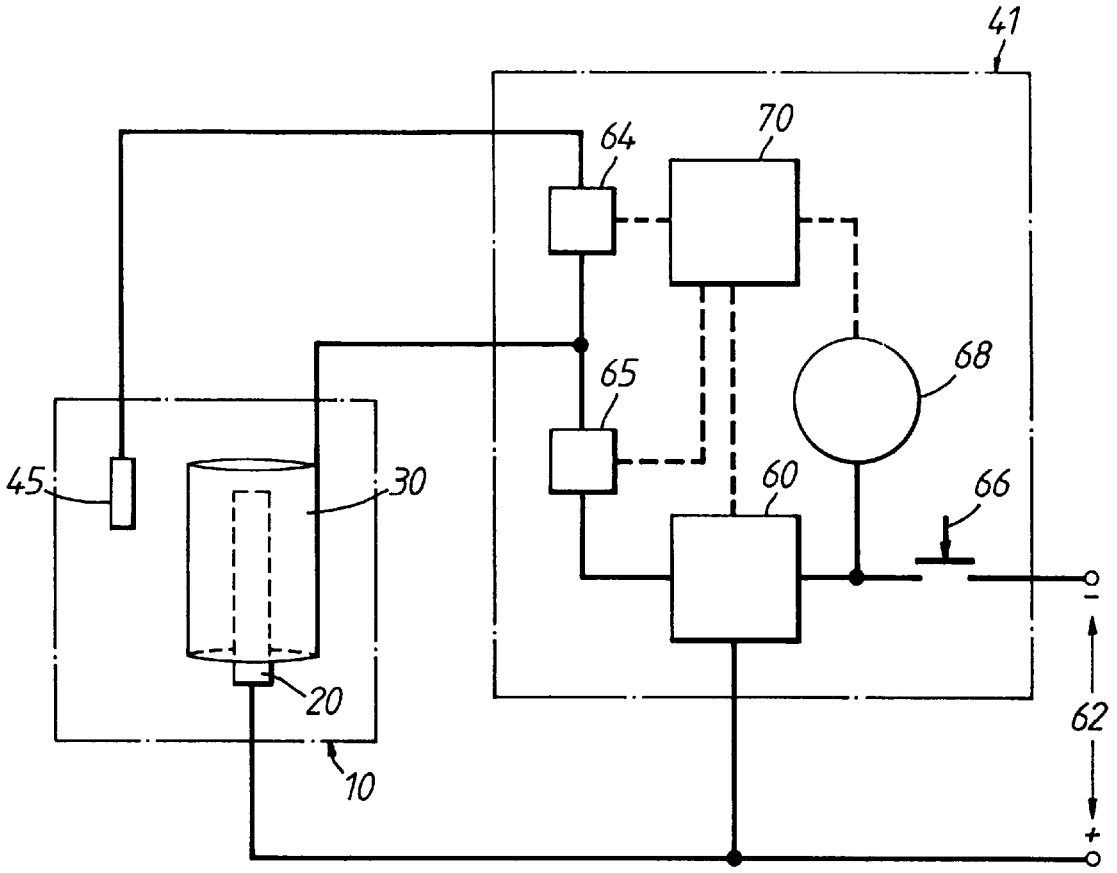
FIG. 3 is a schematic representation of a control circuit for use in the present invention.

FIG. 3 shows the apparatus for de-silvering silver-containing solutions comprising the electrolytic cell 10, the anode 20, the cathode 30 and the reference electrode 45 positioned adjacent the cathode. Electrical power supply control means in the form of the potential control device 41 is provided for controlling the supply of electrical power to the anode 20 and the cathode 30. The potential control device 41 includes a potentiometer 60 for adjusting the potential difference applied from a power source 62 between the anode 20 and the cathode 30. A voltage meter 64 measures the potential difference between the cathode 30 and the reference electrode 45 and a current meter 65 measures the current flow through the cell. A start switch 66 initiates the start of a de-silvering process by completing the connection between the power source 62 and the cathode 30. A timer 68 measures the time elapsed from the operation of the start switch 66. A control circuit 70 is linked to the voltage meter 64, the current meter 65 and the timer 68 and is programmed to adjust the potentiometer 60 in response to the timer 68, the voltage meter 64 and the current meter 65 in accordance with the invention.

EXAMPLE 1

Initially, voltage meter 64 provides an indication of the rest potential of the cell 10. This is used to determine a suitable threshold value for current passing through the cell. By way of example, in the field of X-ray film processing one expects to work with fixer solutions having a pH within the range 4.2 to 4.8. A rest potential of −458 mV in a silver-containing solution with a pH of 4.6 implies that the solution contains silver in an amount of 1 g/L. However, if the pH were 4.2, that rest potential would imply a silver content of about 2.5 g/L and if the pH were 4.8, the silver content would be about 0.63 g/L for that rest potential. A solution containing silver about 0.63 g/L will support a de-silvering current in the equipment described of at least 1250 mA. Thus this conservative value is taken as the threshold value of current magnitude corresponding to that rest potential.

It has been demonstrated in EP-Application 92 203 439.2, having EP-Publication n° 0 598 144 A1 (Agfa-Gevaert NV) that a normal potentiostatically maintained operating potential of −530 mV can be tolerated without giving rise to any significant unwanted side-reactions. The cathode is accordingly placed at a potential of −530 mV with respect to a glass reference electrode and the current is monitored. In the absence of poisoning, the resulting current might be about 2300 mA or more, that is, well above the threshold value of 1250 mA. The cathode is then maintained at that potential with respect to the reference electrode.

It may be expected that cathode poisoning will develop, and as a result, despite that cathode potential being maintained, the magnitude of the current through the cell will drop below the threshold value.

When this happens, the control system switches to control the cell galvanostatically at that threshold current value. Eventually, the cell will naturally become detoxified, at least the threshold current will be maintained and the fixer will continue to become de-silvered.

As the cathode starts to become detoxified, the cathode potential necessary to maintain the threshold current will become progressively less negative, thus is may go from, say, −590 mV through −570 mV, −550 mV, −540 mV, −535 mV, and so on, until the potentiostatic potential, in this particular example −530 mV, is reached. At that stage, potentiostatic control is re-instated, and the cathode potential is no longer permitted to become less negative, but is instead maintained at the potentiostatic potential, namely −530 mV.

It will be appreciated that the silver content of the electrolyte solution will drop as de-silvering continues. It will also be appreciated that the silver content may rise as further electrolyte solution is added to the cell. Accordingly the opportunity is also taken of periodically re-measuring the rest potential of the cell in order to re-estimate the silver content of the solution and thus re-set the threshold current value.

EXAMPLE 2

This example illustrates a cycle of operation of a cell utilising the principles of this invention for the on-line de-silvering of fixer using an HT330 processor and materials commercially available from Agfa-Gevaert NV. The fixer used was G334c (hardening) fixer processing Curix™ ortho HT film with fixer regeneration of 200 mL/m$^2$.

Figure 4:
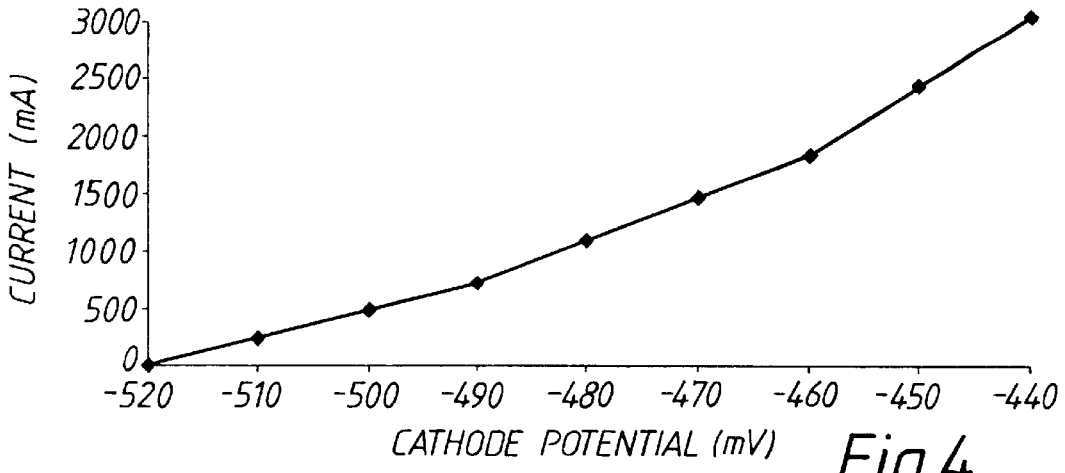
FIG. 4 is a graph of cathode rest potential against threshold current for a particular set of conditions.

Under these conditions, a desirable relationship between cathode rest potential (versus a glass reference electrode) and threshold current for the de-silvering cell is shown in the graph which forms FIG. 4.

Figure 5:
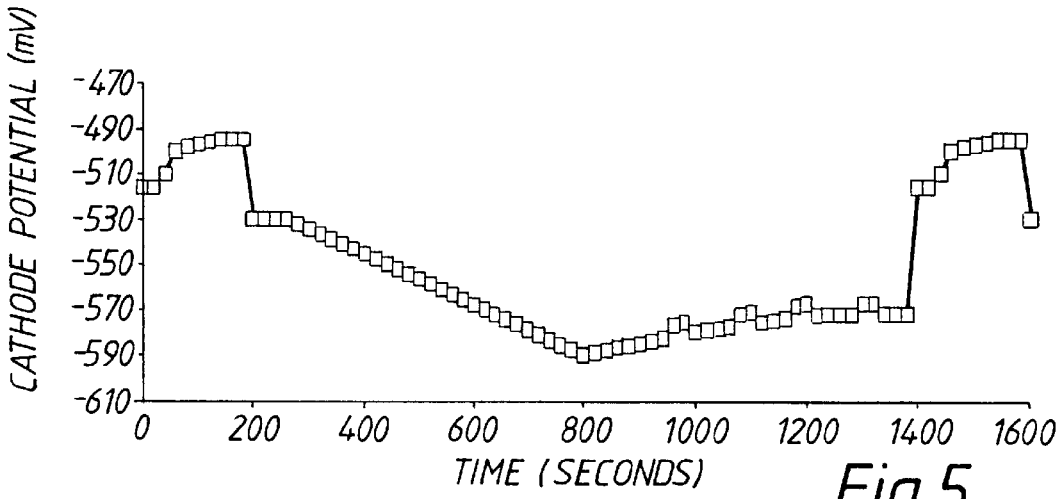
FIGS. 5 and 6 are graphs respectively of cathode potential (in mV) and current (mA) against time (seconds) for a particular cell during one cycle of operation.
Figure 6:
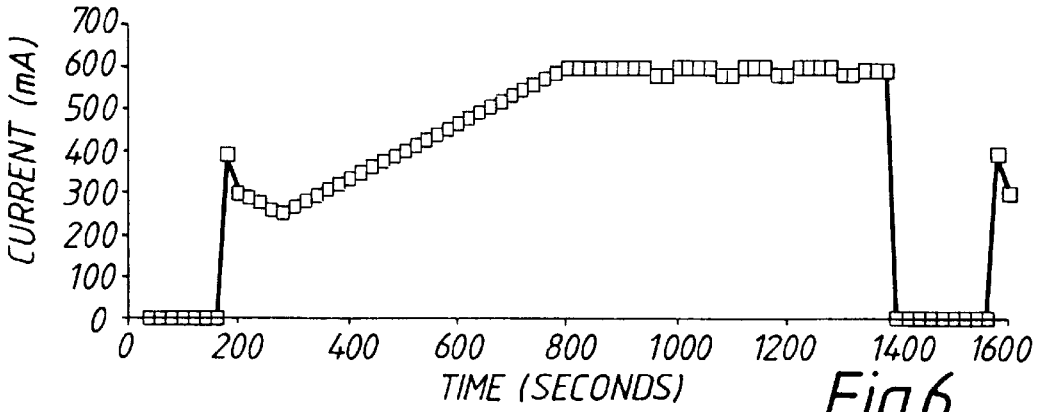

With reference to FIGS. 5 and 6, at time T=0, no current is drawn (FIG. 6),and the cell is allowed to establish equilibrium conditions for the measurement of its rest potential. By time T=180 (i.e. after 3 minutes), the rest potential has stabilised at −495 mV (FIG. 5). From the graph of FIG. 4, this value corresponds with a minimum threshold current value of 600 mA.

Again, it is known that in these circumstances, a normal potentiostatically maintained operating potential of −530 mV can be tolerated without giving rise to any significant unwanted side-reactions, and this working potential is set after T=180.

The cell is operated potentiostatically at −530 mV briefly, but it is noted that the current is low and indeed decreasing, thus giving only a slow de-silvering of the fixer.

Accordingly, at about T=250, the potential applied to the cathode is given greater negative values while monitoring the current passing the cell, until that current has reached the value of 600 mA which it does at T=800.

Between T=800 and T=1400, a constant current of approximately 600 mA is drawn. During this period it is noted that there is a slight rise in the cathode potential required to draw that current (i.e. the cathode becomes less negative). This is due to detoxification of the cell.

At T=1400, a new cycle commences with a re-measurement of the rest potential of the cell.

We claim:

1. A process for de-silvering a silver-containing solution by use of an electrolytic cell having an anode, a cathode and a reference electrode, the process comprising:

(i) supplying silver-containing solution to the electrolytic cell to immerse the anode, cathode and reference electrode therein; and (ii) applying electrical power to the anode and the cathode such that a voltage potential of the cathode relative to the reference electrode lies within a de-silvering range to cause silver to be deposited on the cathode; wherein the operation of the cell is controlled potentiostatically while the current exceeds a certain threshold value and the current is controlled galvanostatically at the threshold value in circumstances in which the potentiostatic control would result in a current below the threshold value.

2. A process according to claim 1, wherein the potentiostatic control is performed to control the magnitude of the potential between the cathode and the reference electrode at a value between −20 mV and −300 mV.

3. A process according to claim 1, wherein the magnitude of the cathode potential at which such potentiostatic control is performed is determined at least in part in dependence upon the pH of the electrolyte.

4. A process according to claim 1, wherein the cathode potential is measured with reference to a reference electrode which is itself pH-sensitive.

5. A process according to claim 4, wherein the cathode potential is measured with reference to a glass reference electrode.

6. A process according to claim 5, wherein the reference electrode is a glass reference electrode having a potential of about +208 mV with respect to NHE at pH 7, and during potentiostatic operation, the cathode potential is maintained between −500 mV and −600 mV with respect to the reference electrode.

7. A process according to claim 1, wherein the cell has inlet and outlet ports via which electrolyte is circulated through the cell.

8. A process according to claim 1, wherein the magnitude of said threshold value of current passing through the cell is determined at least in part in dependence upon the rest potential of the cell.

9. A process according to claim 8, wherein the magnitude of said threshold value of current passing through the cell is periodically redetermined.

10. A process according to claim 1, wherein the magnitude of said threshold value of current passing through the cell is determined at least in part in dependence upon analysis of response of the current to changes in the applied potentials.

11. Apparatus for de-silvering a silver-containing solution including an electrolytic cell having an anode, a cathode and a reference electrode positioned adjacent said cathode, and electrical power supply control means for controlling the supply of electrical power to said anode and said cathode, said power supply control means including means for adjusting a voltage potential of said cathode relative to said anode and said reference electrode, and control means linked to said adjustment means, wherein said control means includes means for controlling operation of the cell potentiostatically at a selected cathode potential, means for monitoring the current drawn through the cell during such potentiostatic control and for comparing such current with a threshold current, and means for controlling the cell galvanostatically at such threshold current value, means for switching from potentiostatic to galvanostatic control in response to cell current dropping below said threshold value, means for periodically re-establishing said selected cathode potential, and means for reverting from galvanostatic to said potentiostatic control in response to a cell current above said threshold value when said selected cathode potential is re-established.

12. Apparatus according to claim 11, wherein the cathode potential is measured with reference to a glass reference electrode having a potential of about +208 mV with respect to NHE at pH 7.

13. Apparatus according to claim 11, wherein said control means includes means for analysing response of the current to changes in the applied potentials and for adjusting the magnitude of said threshold value of current passing through the cell at least in part in dependence thereon.

14. Apparatus according to claim 11, wherein the control means comprises means for determining the rest potential of the cell.

15. Apparatus according to claim 14, wherein the control means comprises means arranged to redetermine the rest potential of the cell periodically.

* * * * *

UNITED STATES PATENT AND TRADEMARK OFFICE

CERTIFICATE OF CORRECTION

PATENT NO. : 5,951,844

DATED : September 14, 1999

INVENTOR(S) : Jansen et al.

It is certified that error appears in the above-identified patent and that said Letters Patent is hereby corrected as shown below:

Title Page, Item [56] References Cited, U.S. PATENT DOCUMENTS: "5,770,034 6/1998 Janset et al." should read -- 5,770,034 6/1998 Jansen et al. --;

Column 2, line 16, "potential" should read -- Potential --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*